US008165516B2

(12) United States Patent
Tomoe

(10) Patent No.: US 8,165,516 B2
(45) **Date of Patent: *Apr. 24, 2012**

(54) CLEANING DEVICE WITH SOLID LUBRICATING MEMBER AND IMAGE FORMING APPARATUS PROVIDED WITH THE SAME

(75) Inventor: Tetsuro Tomoe, Osaka (JP)

(73) Assignee: Kyocera Mita Corporation (JP)

( * ) Notice: Subject to any disclaimer, the term of this patent is extended or adjusted under 35 U.S.C. 154(b) by 734 days.

This patent is subject to a terminal disclaimer.

(21) Appl. No.: 12/197,333

(22) Filed: Aug. 25, 2008

(65) Prior Publication Data

US 2009/0052959 A1 Feb. 26, 2009

(30) Foreign Application Priority Data

Aug. 24, 2007 (JP) ..... 2007-217898

(51) Int. Cl.
*G03G 21/00* (2006.01)

(52) U.S. Cl. ..... 399/345; 399/346

(58) Field of Classification Search ..... 399/345, 399/346

See application file for complete search history.

(56) References Cited

U.S. PATENT DOCUMENTS

| | | | | |
|---|---|---|---|---|
| 2007/0172273 | A1* | 7/2007 | Harada et al. | 399/346 |
| 2007/0183824 | A1* | 8/2007 | Suda et al. | 399/346 |
| 2008/0118285 | A1* | 5/2008 | Karasawa | 399/346 |

FOREIGN PATENT DOCUMENTS

| | | |
|---|---|---|
| JP | 7-271142 | 10/1995 |
| JP | 2006-184885 | 7/2006 |

* cited by examiner

*Primary Examiner* — David Gray
*Assistant Examiner* — Billy J Lactaoen
(74) *Attorney, Agent, or Firm* — Gerald E. Hespos; Michael J. Porco

(57) ABSTRACT

A cleaning device cleans a toner forming surface of a rotating image bearing member. The cleaning device includes: a cleaning member for cleaning the image forming surface, the cleaning member having a first length in a width direction which is perpendicular to a rotational direction of the image bearing member, and being capable of coming in contact with and separating from the image forming surface; and a solid lubricating member which comes in contact with the cleaning member to give a lubricity to the image forming surface through the cleaning member, the solid lubricating member having a second length in the width direction which is shorter than the first length.

18 Claims, 9 Drawing Sheets

CLEANING DEVICE WITH SOLID LUBRICATING MEMBER AND IMAGE FORMING APPARATUS PROVIDED WITH THE SAME

BACKGROUND OF THE INVENTION

1. Field of the Invention

The present invention relates to cleaning devices used in image forming apparatuses such as a copying machine, a printer, and a facsimile machine, and also relates to image forming apparatuses provided with the same.

2. Description of the Related Art

Generally, an image forming apparatus includes an image bearing member, and a toner image formed on an image forming surface of the image bearing member is transferred to a sheet at a transfer nip portion. There have been known a cleaning device which performs a cleaning processing of removing toners remaining on the image forming surface after a transfer processing is performed (for example, refer to Japanese Patent Unexamined Publication No. 2006-184885), and a cleaning device which applies a lubricating agent to the image forming surface (for example, refer to Japanese Patent Unexamined Publication No. H07-271142).

In the former apparatus, a cleaning brush is provided so as to be capable of coming in contact with or being separated apart from the image forming surface. The brush comes in contact with the image forming surface, so that the image forming surface is cleaned. In the latter apparatus, a solid lubricating agent is provided near the brush. The lubricating agent comes in contact with the brush, so that the lubricating agent is applied to the image forming surface through the brush. Accordingly, the surface friction factor of the image forming surface can be suppressed to be low.

Meanwhile, the brush with which the above-described lubricating agent comes in contact has an axis line extending along a direction in which the transfer nip portion is formed, and an axis line of the solid lubricating agent also extends so as to be substantially parallel to the axis line of the brush. It is preferable that the solid lubricating agent comes in contact with the brush evenly along its widthwise direction. This is because, if the lubricating agent has a contact parts and non-contact part with respect to the brush, it is necessary to perform maintenance for the lubricating agent frequently.

Further, a sheet to which the toner image is transferred includes a smoother for smoothing the surface of the sheet. Further, it should be noticed that a developer supplied to the image forming surface includes not only toners but also an external additive for toner used for polishing the surface of the image forming surface. This is because while the smoother and the external additive for toner achieve a desired function, they may contaminate the image forming surface and opposite end portions of a sheet.

As described above, a cleaning device needs some measures for making the lubricating agent be maintenance-free and enhancing image quality, but the conventional technologies described above do not take this point in consideration.

SUMMARY OF THE INVENTION

An object of the present invention is to provide a cleaning device which makes a lubricating agent be maintenance-free and maintain favorable image quality, and an image forming apparatus provided with the same.

A cleaning device in accordance with an aspect of the present invention achieving the object includes a cleaning device for cleaning a toner image forming surface of a rotating image bearing member. The cleaning device includes: a cleaning member for cleaning the image forming surface, the cleaning member having a first length in a width direction which is perpendicular to a rotational direction of the image bearing member, and being capable of coming in contact with and separating from the image forming surface; and a solid lubricating member which comes in contact with the cleaning member to give a lubricity to the image forming surface through the cleaning member, the solid lubricating member having a second length in the width direction which is shorter than the first length.

Further, an image forming apparatus in accordance with another aspect of the present invention includes: an image bearing member provided with an image forming surface on which a toner image is formed; and a cleaning device for cleaning the image forming surface. The cleaning device has the configuration described above.

These and other objects, features and advantages of the present invention will become more apparent upon reading of the following detailed description along with the accompanied drawings.

DETAILED DESCRIPTION OF THE PREFERRED EMBODIMENTS

Figure 1:
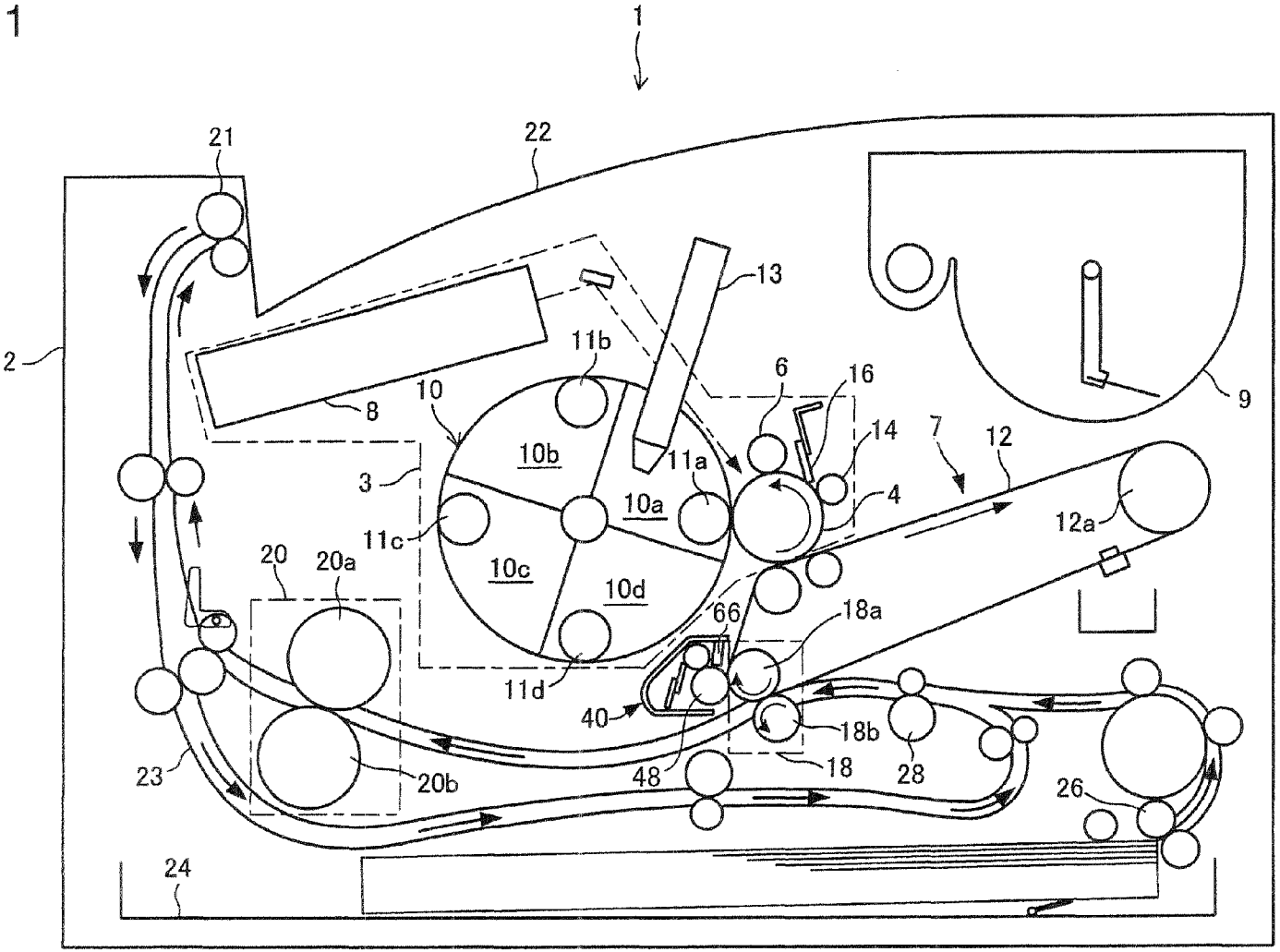
FIG. 1 shows a schematic configuration of a printer in accordance with an embodiment of the present invention.

FIG. 1 shows a schematic configuration of a printer 1 (image forming apparatus) in accordance with an embodiment of the present invention. A right side in the drawing corresponds to a front side of the printer 1, and a left side corresponds to a back side.

In an apparatus main body 2 of the printer 1, there is provided an image forming section 3 having a photoconductive drum 4. On an outer peripheral surface of the photoconductive drum 4, a layer of a photoconductive member made of, for example, amorphous silicon is formed. The photoconductive drum 4 is rotated in a counter-clockwise direction in FIG. 1, and a series of operations including forming of an electrostatic latent image, developing of an electrostatic latent image by toners, and primary transferring of a toner image is performed on the outer peripheral surface.

In particular, in periphery of the photoconductive drum 4, there is provided a charging device 6 which comes close to an upper position of the photoconductive drum 4. The charging device 6 charges the outer peripheral surface of the photoconductive drum 4. In a state where the photoconductive drum 4 is charged, a scanning light is irradiated from a laser scanning unit 8 to the outer peripheral surface.

The unit 8 rotates, for example, a polygon mirror at a high speed to reflect the laser light, and the laser light scanning in a rotational axis direction of the photoconductive drum 4 is reflected by a flat mirror, so that the outer peripheral surface of the photoconductive drum 4 is subjected to an exposure. Accordingly, an electrostatic latent image is formed on the outer peripheral surface of the photoconductive drum 4.

Further, in a rotational direction of the photoconductive drum 4, there is disposed a developing unit 10 on a downstream of a position to which the scanning light is irradiated. The developing unit 10 is so provided as to come close to the outer peripheral surface of the drum 4, and the electrostatic latent image is developed with toners of four colors (for example, magenta, cyan, yellow, and black) in a rotary method. In other words, the developing unit 10 is so configured as to be also rotatable, and has four developing equipments 10*a*, 10*b*, 10*c*, and 10*d* partitioned for respective colors along its rotational direction.

The developing equipments 10*a*-10*d* contain toners and are provided with developing rollers 11*a*-11*d* which rotate while bearing toners on their respective outer peripheral surfaces. Further, at an appropriate position near the front side of the printer 1, there is provided a toner container 9. Toners of respective colors are supplied to the developing equipments 10*a*-10*d* through a feed pipe 13.

Rotation of the developing unit 10 causes some of the developing equipments 10*a*-10*d* corresponding to colors which should be developed to approach and stop to face the outer peripheral surface of the photoconductive drum 4. On the other hand, in the developing equipments 10*a*-10*d*, the developing rollers 11*a*-11*d* rotate while bearing toner thin layers on their respective outer peripheral surfaces, and a developing bias voltage including an AC component and a DC component is applied to the rollers 11*a*-11*d*. Accordingly, the toners bore on the rollers 11*a*-11*d* are transferred to the electrostatic latent images on the drum 4, so that the electrostatic latent images are developed by toners of respective colors.

In periphery of the photoconductive drum 4, there are provided a rubbing member 14 and a cleaning member 16 along the outer peripheral surface. The rubbing member 14 and the cleaning member 16 are provided on an upstream in the rotational direction of the photoconductive drum 4. After the toner image is primarily transferred, the rubbing member 14 polishes the outer peripheral surface of the drum 4, and then removes oxidized products adhered to the photoconductive member layer. On the other hand, the cleaning member 16 removes toners remaining on the outer peripheral surface of the photoconductive drum 4 to clean the outer peripheral surface before the next image forming is performed.

Beneath the photoconductive drum 4 and the toner container 9, there is provided an intermediate transferring unit 7. The intermediate transferring unit 7 includes an endless intermediate transferring belt 12 (image bearing member), and its surface (image forming surface) is disposed so as to come close to the outer peripheral surface of the drum 4. The intermediate transferring belt 12 includes, for example, a belt formed by a sheet member made of dielectric resin and whose opposite end portions are layered to be connected, or a (seamless) belt having no seam.

The intermediate transferring belt 12 is wound around a driving roller 18*a* and a tension roller 12*a*, and a primary transfer position with respect to the drum 4 is provided between the rollers. Specifically, the driving roller 18*a* is disposed on upstream of the primary transfer position in a rotational direction of the intermediate transferring belt 12, and the tension roller 12*a* is disposed on downstream. An appropriate amount of tension toward the intermediate transferring belt 12 is applied to the tension roller 12*a* by a repelling force of, for example, a spring which is not illustrated.

The intermediate transferring belt 12 comes in contact with the outer peripheral surface of the photoconductive drum 4 at a transfer position and runs (rotates) in a circumferential direction in synchronization with rotation of the photoconductive drum 4. The toner image formed on the photoconductive drum 4 is primarily transferred from the outer peripheral surface to the surface of the intermediate transferring belt 12.

A secondary transferring section 18 is configured by the driving roller 18*a* and a transferring roller 18*b* (transferring member). The transferring roller 18*b* rotates in pair with the roller 18*a* while sandwiching the intermediate transferring belt 12, and a transfer nip portion is formed between the intermediate transferring belt 12 and the transferring roller 18*b*.

In FIG. 1, a sheet (sheet-like recording medium) conveying direction is indicated by an arrow. In a lower portion of the apparatus main body 2, a sheet-supplying cassette 24 is disposed, and sheets are stacked and accommodated in the cassette 24. On a downstream side of the cassette 24 in the sheet conveying direction, there are disposed a sheet-feeding roller 26, a registration roller 28, the transferring section 18, and a fixing section 20 sequentially. If a sheet passes through the transferring section 18, a full-color toner image for one page is secondarily transferred from the intermediate transferring belt 12 to the sheet.

The fixing section 20 includes a heating roller 20*a* and a pressing roller 20*b*, and a fixing nip portion is defined by a pressed-contact portion between the rollers 20*a* and 20*b*. The sheet onto which the toner image is transferred is conveyed to the fixing nip portion and then heated and pressed, so that the toner image is fixed to the sheet.

In a case where an image is formed only on one side of the sheet, the sheet which has passed through the fixing section 20 is discharged to the sheet-discharging tray 22 through the sheet-discharging roller 21. On the other hand, in a case where images are formed on both sides of the sheet, the sheet which has passed through the fixing section 20 is pulled back to a sheet-reversing passage 23 through the reversely rotated sheet-discharging roller 21. One end of the passage 23 is connected between the sheet-feeding roller 26 and the registration roller 28, and the sheet in the passage 23 is conveyed again toward the transferring section 18.

Near the secondary transferring section 18 in accordance with the present embodiment, there is disposed a cleaning unit (cleaning device) 40. The cleaning unit 40 is provided so as to face the driving roller 18*a* of the intermediate transferring unit 7. After the toner image on the intermediate transferring belt 12 is secondarily transferred to the sheet, the cleaning unit 40 removes remaining toners adhered to the intermediate transferring belt 12.

Figure 2:
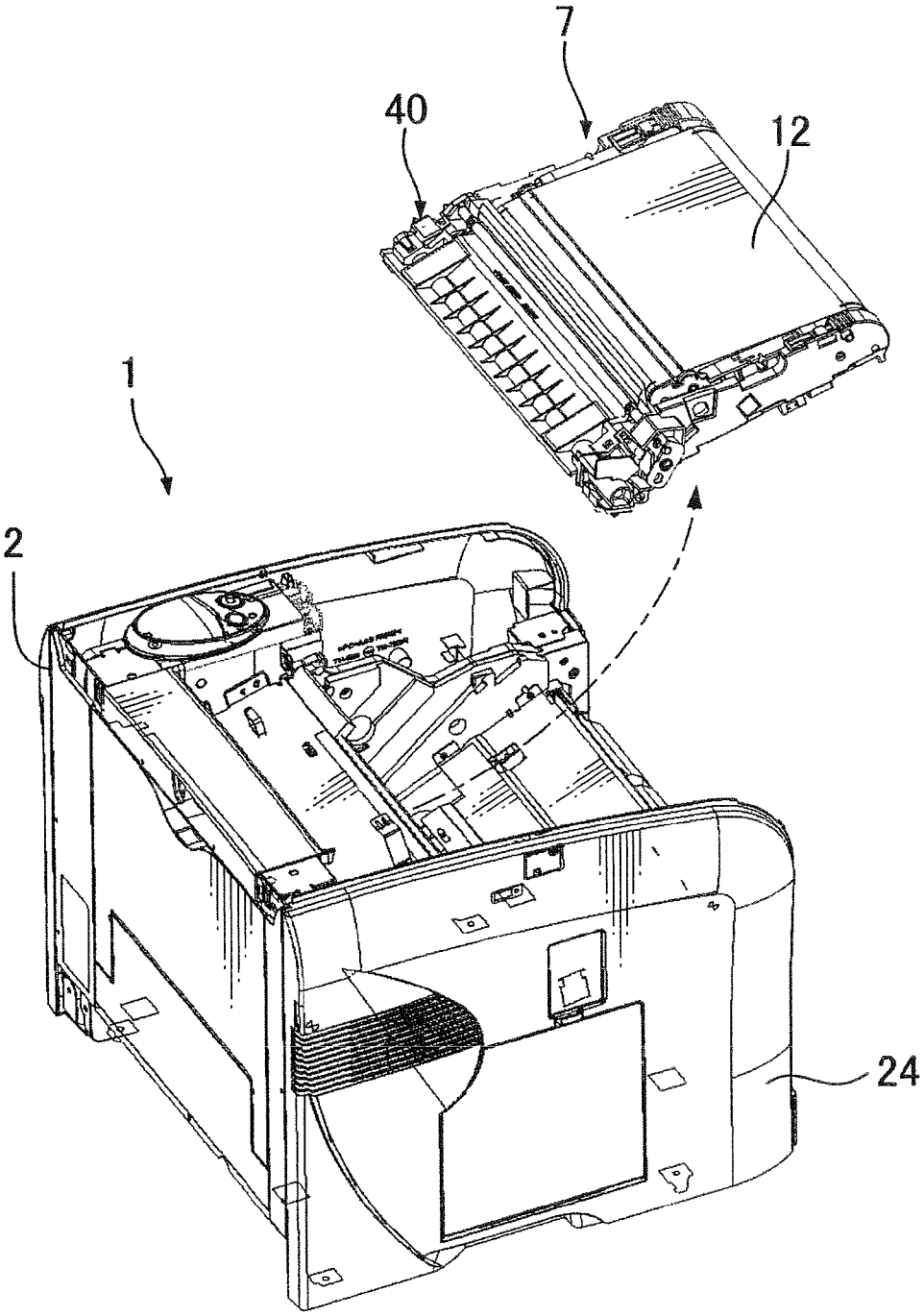
FIG. 2 is a perspective view showing a state where an intermediate transferring unit and a cleaning unit are dismounted from the printer shown in FIG. 1.

FIG. 2 is a perspective view showing a state where the intermediate transferring unit 7 and the cleaning unit 40 are dismounted from the apparatus main body 2. In FIG. 2, an exterior cover and the like of the apparatus main body 2 are omitted from the drawing. If the exterior cover is opened, and the toner container 9 is dismounted, the intermediate transferring unit 7 is exposed to outside. In this state, if a user grabs, for example, an unillustrated handle portion and pulls out the intermediate transferring unit 7 toward an oblique upper right direction, the cleaning unit 40 is also dismounted together with the intermediate transferring unit 7 from the apparatus main body 2.

Figure 3:
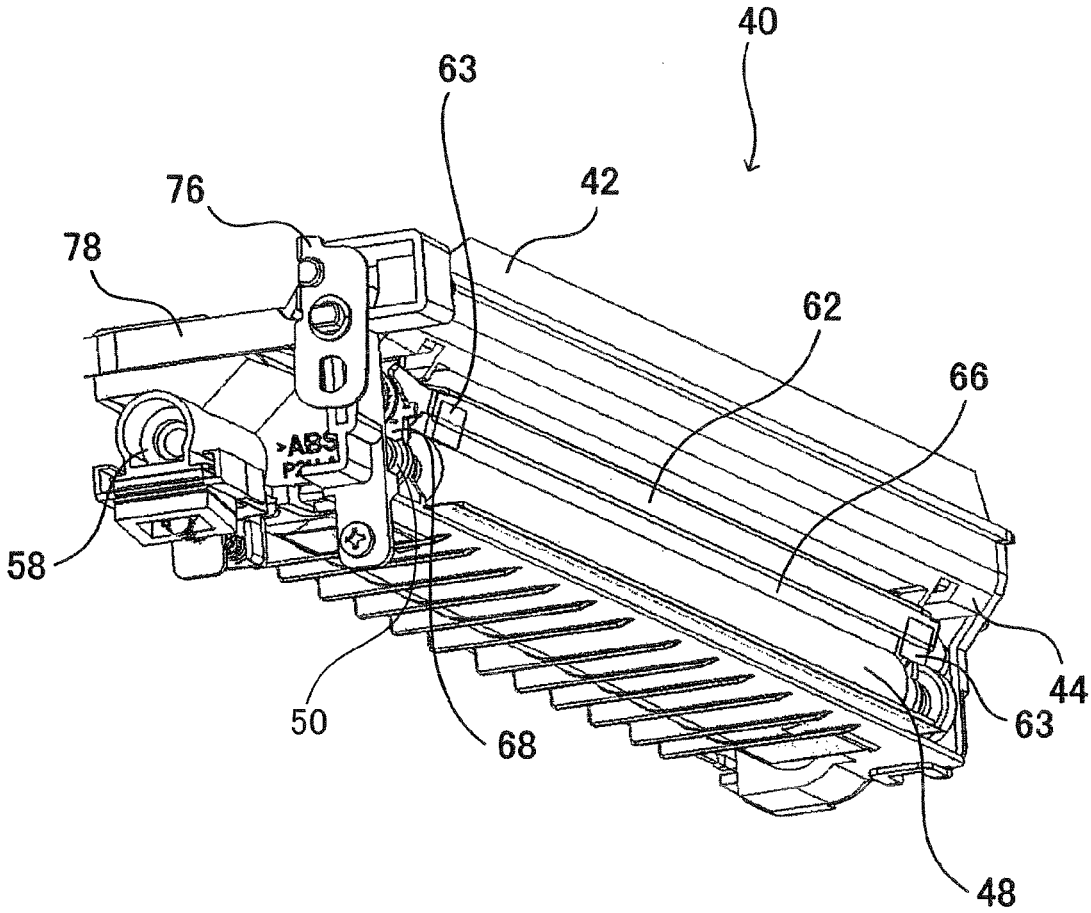
FIG. 3 is a perspective view of the cleaning unit.
Figure 4:
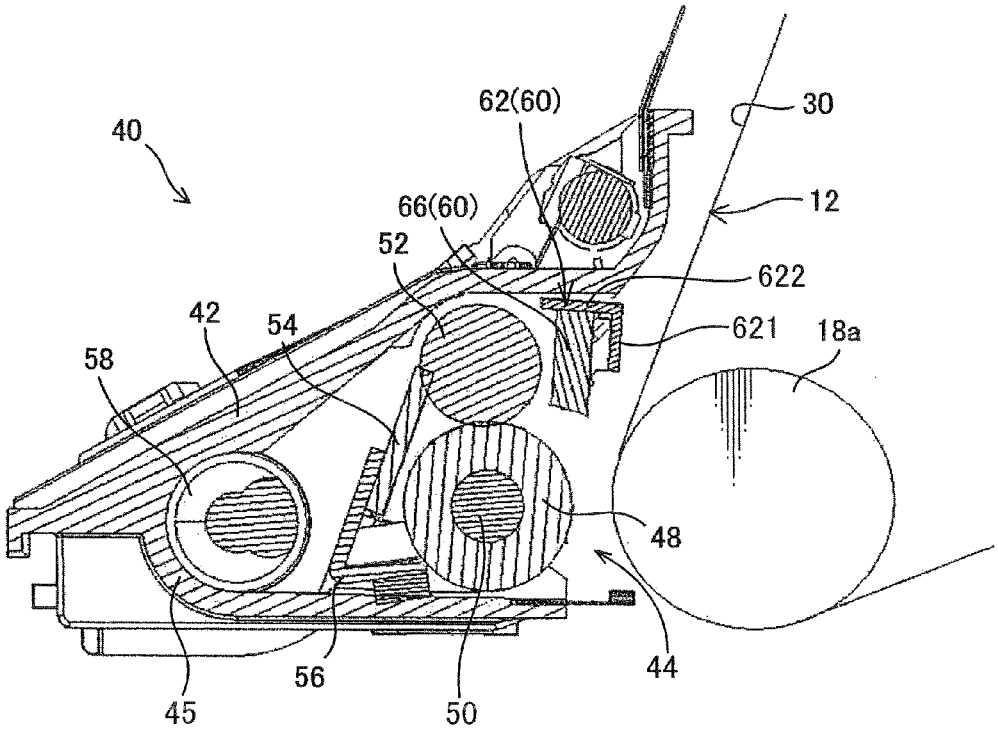
FIG. 4 is a sectional view of the cleaning unit shown in FIG. 3.

FIG. 3 is a perspective view of the cleaning unit. FIG. 4 is a sectional view of the cleaning unit shown in FIG. 3. In the cleaning unit 40, there is provided a roller-like fur brush 48 (cleaning member; roller-like brush member) is provided. The fur brush 48 has a rotational shaft 50 extending in a widthwise direction perpendicular to a rotational direction of the intermediate transferring belt 12, and is rotated about an axis of the rotational shaft 50. The fur brush 48 is disposed at a position of opposing to the driving roller 18*a* and rotates in contact with the intermediate transferring belt 12, so as to electrically remove the toners, which remain after the secondary transfer, from the image forming surface of the intermediate transferring belt 12.

As shown in FIG. 4, the cleaning unit 40 has a housing 42. The housing 42 has an opening 44 which is open toward the intermediate transferring belt 12. The opening 44 faces an image forming surface 30 which is a surface of the intermediate transferring belt 12. Further, the vertical size of the housing 42 is set to become gradually smaller from the opening 44 to a bottom portion 45, and a collecting spiral 58 is disposed near the bottom portion 45.

The fur brush 48 is provided at a position close to the opening 44, and its rotational shaft 50 is provided so as to be substantially parallel to the axis line of the driving roller 18*a*. Opposite ends of the rotational shaft 50 are supported freely rotatably by a plate 68 positioned near side surfaces of the housing 42 (FIGS. 3 and 5).

In the housing 42, there is provided a sweeping roller 52. The sweeping roller 52 is disposed above the fur brush 48 and is substantially parallel to the axis line of the fur brush 48. Opposite ends of the rotational shaft 53 of the sweeping roller 52 are also supported freely rotatably by the plate 68.

To the fur brush 48 and the sweeping roller 52, a voltage can be applied from an unillustrated power source. In a state where a voltage is applied to the rollers, the sweeping roller 52 comes in frictional contact with the fur brush 48 to electrically pick up remaining toners adhered to the fur brush 48.

Figure 5:
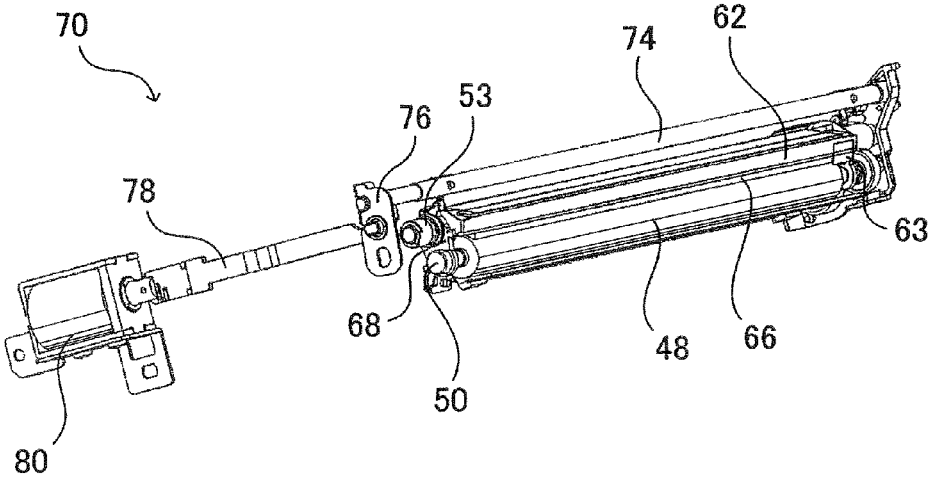
FIG. 5 is a perspective view showing relevant parts of the cleaning unit.
Figure 6:
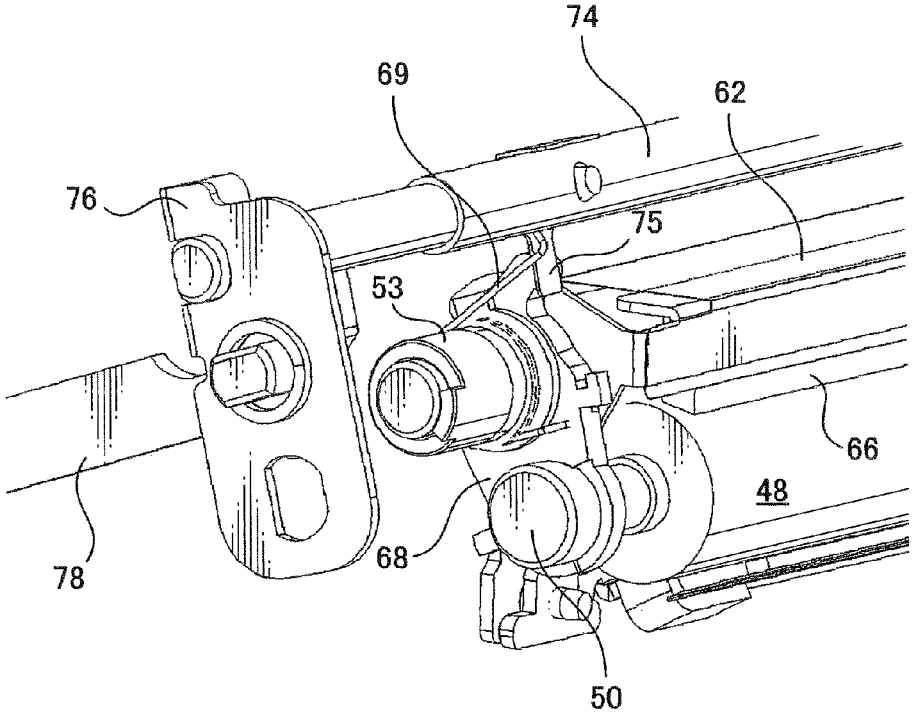
FIG. 6 is an enlarged view of FIG. 5 and shows a separating operation.

FIG. 6 is an enlarged view of FIG. 5. The rotational shaft 53 of the sweeping roller 52 and the rotational shaft 50 of the fur brush 48 are engaged by a torsion spring 69. The torsion spring 69 urges the fur brush 48 toward a direction of separating apart from the image forming surface 30.

Referring back to FIG. 4 again, a supporter 56 is disposed between the fur brush 48 and the collecting spiral 58, and the supporter 56 is provided with a blade 54. The blade 54 is disposed so as to be capable of coming in contact with the sweeping roller 52 to scrape off the remaining toners which are in contact with and adhered to the outer peripheral surface of the sweeping roller 52. The toners which are scraped off are conveyed by the collecting spiral 58 to be collected into an unillustrated waste toner container.

In the housing 42, there is provided a brush bar assembly 60. The assembly 60 is disposed above the fur brush 48 on a side of the sweeping roller 52 closer to the opening 44. The assembly 60 includes a solid lubricating member 66, and a retaining stay 62 for retaining an upper end of the solid lubricating member 66.

The solid lubricating member 66 is an elongated rectangular member provided so as to be substantially parallel to the axis line of the fur brush 48. For example, the solid lubricating member 66 may be a member including a zinc stearate. The solid lubricating member 66 is a member which is so configured as to be capable of coming in contact with the fur brush 48. A lubricating component adhered to the fur brush 48 is given to the intermediate transferring belt 12, so that lubricity is given to the image forming surface 30.

The stay 62 has a substantially L-shaped cross section and includes a front surface 621 so disposed as to face the image forming surface 30 at the opening 44, and an upper surface 622 which is so formed as to be perpendicular to an upper end portion of the front surface 621 and extend toward an inner side of the housing 42. The upper surface 622 retains an upper end of the solid lubricating member 66.

At opposite end portions of the solid lubricating member 66 (opposite end portions in a widthwise direction perpendicular to the widthwise direction of the intermediate transferring belt 12), translucent elastic sheets (closing member) 63, 63 are applied on a front side of the retaining stay 62 (FIG. 3). Each sheet 63 so formed as to be rectangular has an upper half portion applied to the front surface 621 of the retaining stay 62 and a lower half portion extending toward the fur brush 48 to face opposite end portions of the fur brush 48. An axial length of the solid lubricating member 66 is set to be shorter than that of the fur brush 48, and the solid lubricating member 66 and the fur brush 48 are disposed so that respective widthwise center substantially coincide with each other. The difference in lengths defines at opposite end portions of the fur brush 48 non-contact portions at which the fur brush 48 is substantially in noncontact with the solid lubricating member 66. Each sheet 63 has a widthwise length which is substantially the same as a widthwise length of the noncontact portion.

The opposite ends of the stay 62 are supported by the rotational shaft 53 of the sweeping roller 52 freely rotatably on an inner side of the plate 68 (FIGS. 5 and 6). Accordingly, the stay 62 and the solid lubricating member 66 slants downward and toward the brush 48 due to weights of the stay 62 and the solid lubricating member 66 and comes in contact with the fur brush 48 due to an operation of the fur brush 48 moving toward the intermediate transferring belt 12.

The plate 68 is connected to a brush operating mechanism 70 for allowing the fur brush 48 to separate apart from or come in contact with the intermediate transferring belt 12. In particular, as shown FIGS. 5 and 6, the brush operating mechanism 70 has a shaft 74 which is provided above the sweeping roller 52. Two pressure pieces 75 are fixed to the shaft 74, and each pressure piece 75 comes in contact with an upper end side of the plate 68.

The opposite ends of the shaft 74 include one end supported freely rotatably on a side surface of the housing 42 and the other end engaged with an upper side of the plate 76. On a side of the plate 76 lower than its center of gravity, an arm 78 is supported freely rotatably, and the arm 78 extends toward a solenoid 80 fixed to the apparatus main body 2.

In a case where the image forming surface 30 is cleaned, the solenoid 80 is magnetized in accordance with a signal transmitted from an unillustrated controller, so that the arm 78 moves toward the solenoid 80. At the same time, the plate 76 having the shaft 74 rotates in a clockwise direction from the state shown in FIG. 6 to the state shown in FIG. 7. The pressure piece 75 causes the plate 68 to rotate in a counterclockwise direction against a biasing force of the torsion spring 69. Accordingly, the fur brush 48 moves toward the intermediate transferring belt 12 to come in contact with the image forming surface 30, so that the remaining toners on the image forming surface 30 are adhered to the fur brush 48.

Figure 8:
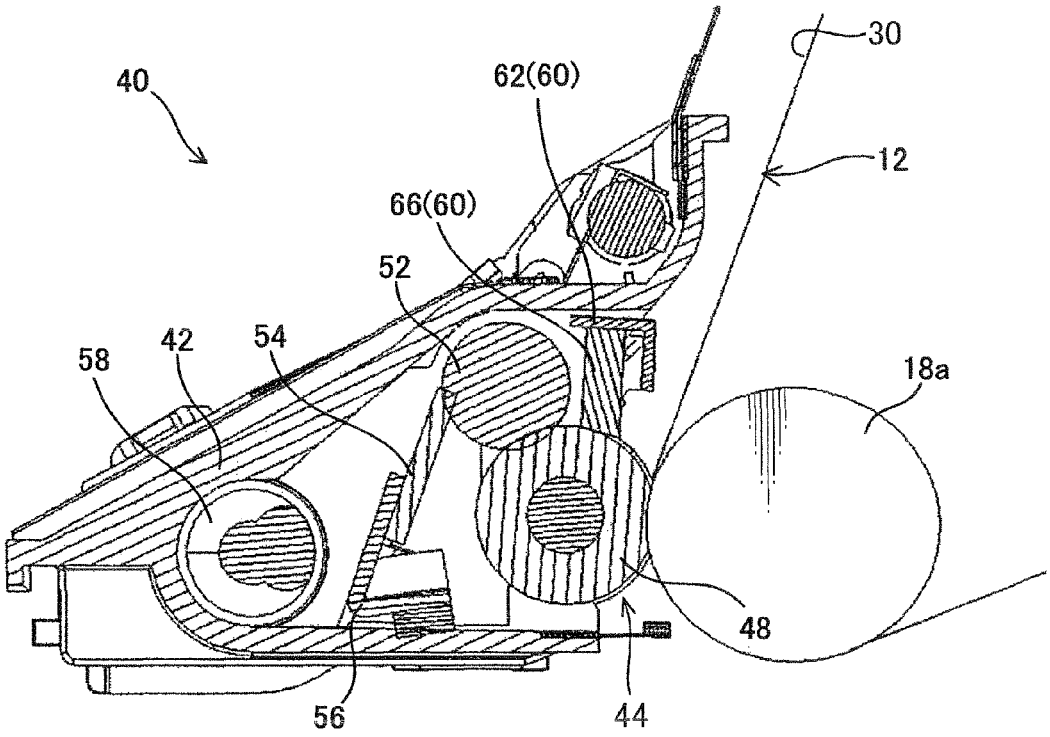
FIG. 8 is a sectional view of a cleaning unit in the state shown in FIG. 7.

This movement of the fur brush 48 causes a lower end of the solid lubricating member 66 to come in contact with the fur brush 48 not at its ridge line but at a surface. The lubricating agent scraped off by this contact is applied to the image forming surface 30 through the fur brush 48 (FIG. 8). Next, the remaining toners adhered to the fur brush 48 are taken by the sweeping roller 52, and then the remaining toners picked by the sweeping roller 52 are scraped off by the blade 54 and collected.

Figure 7:
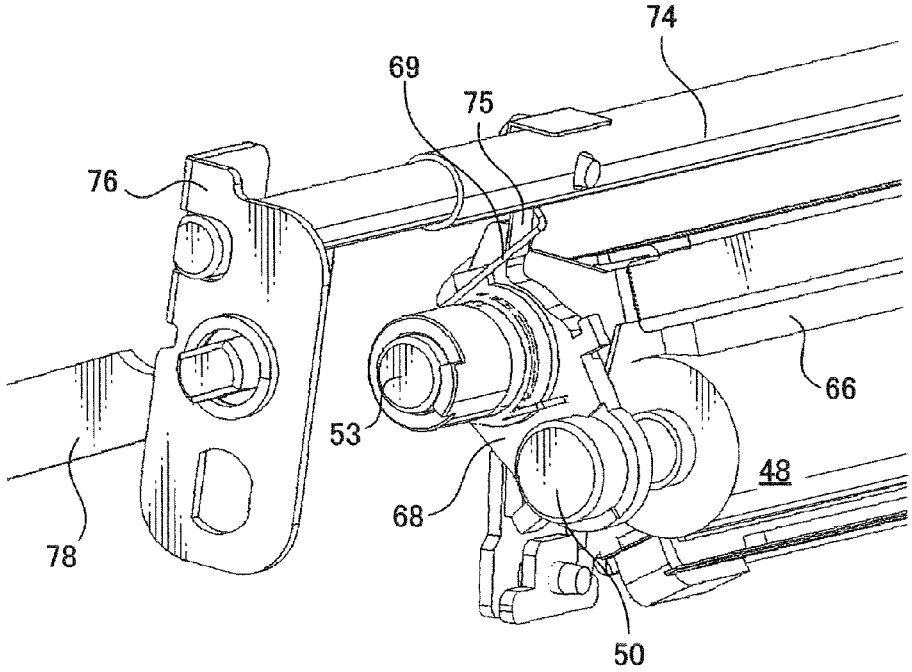
FIG. 7 shows a pressed-contact operation in the cleaning unit shown in FIG. 5.

On the other hand, in a case where the toner image on the image forming surface 30 is secondarily transferred to the sheet, the solenoid 80 is demagnetized, so that a biasing force of the torsion spring 69 causes the plate 68 to rotate in the clockwise direction from the state shown in FIG. 7 to the state shown in FIG. 6. Accordingly, the fur brush 48 moves toward the side of the collecting spiral 58 and separates apart from the image forming surface 30. This movement of the fur brush 48 causes the lower end of the solid lubricating member 66 to separate apart from the fur brush 48 (FIG. 4).

In the present embodiment, respective axial lengths of the fur brush 48, the solid lubricating member 66, the transferring roller 18*b*, and the like, which are described above, are defined with reference to the size of a sheet to be printed.

Figure 9:
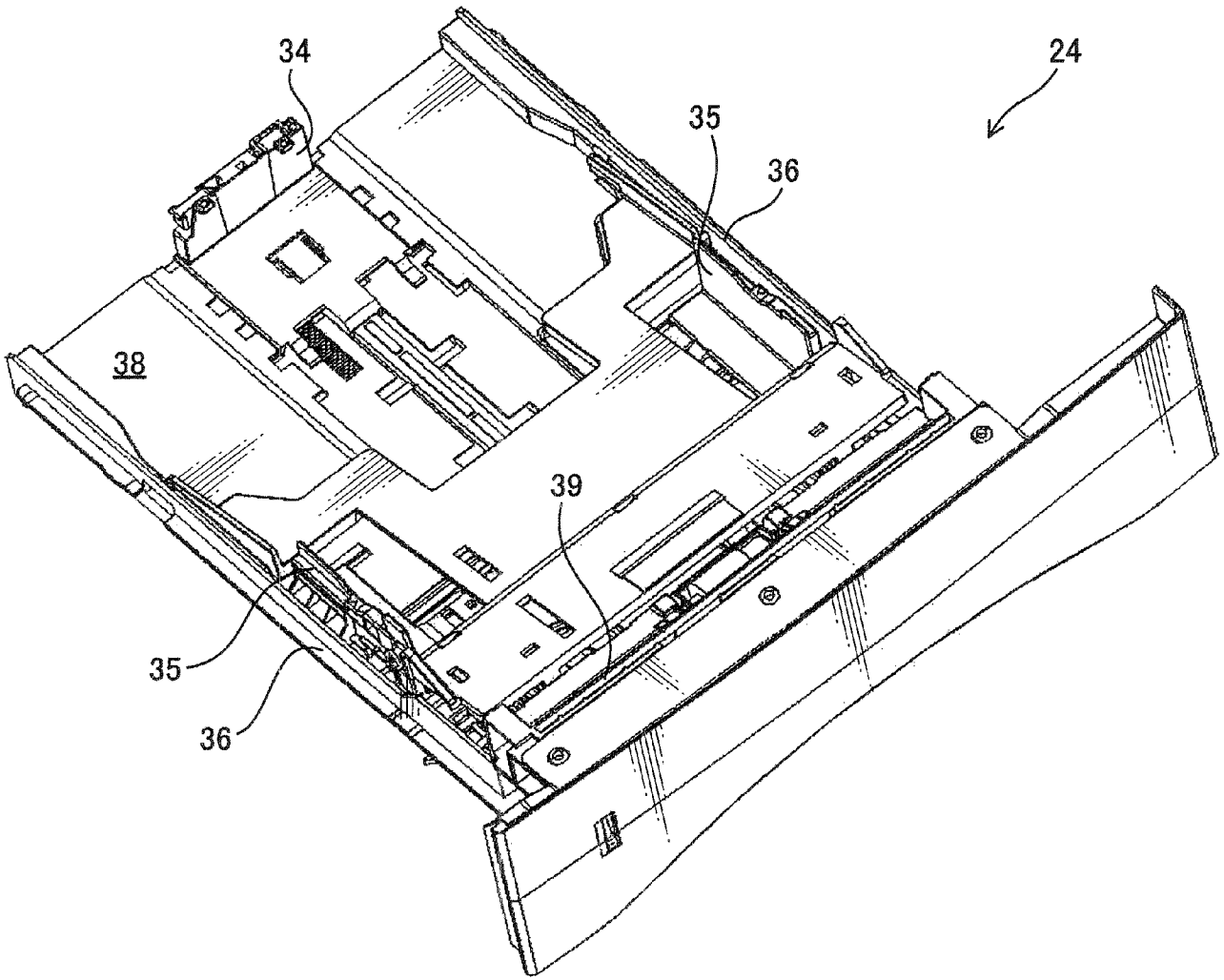
FIG. 9 is a perspective view of a sheet-feeding cassette.
Figure 10:
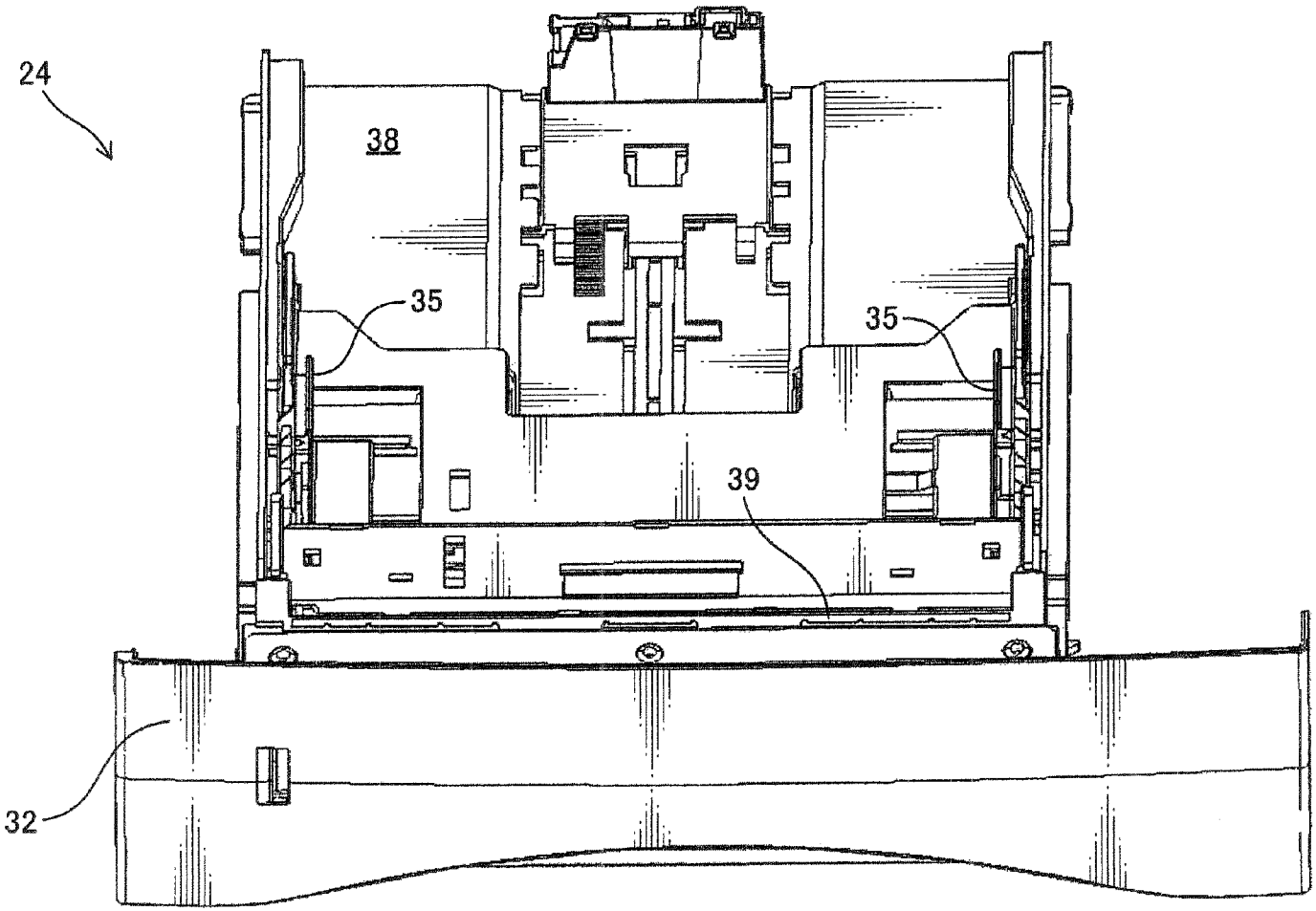
FIG. 10 is a top view of the sheet-feeding cassette.

As shown in FIGS. 9 and 10, the sheet-feeding cassette 24 is provided with a designed surface 32 on a front side of the printer 1, in other words, on a front surface of the sheet-feeding cassette 24. On the left and right end sides of the designed surface 32, side surface portions 36 are formed so as to extend toward a back side of the printer 1. The side surface portions 36 are connected at an end surface portion 34 on a back side of the printer 1, and sheets are stacked and accommodated in an area 38 defined by the designed surface 32, the side surface portions 36, and the end surface portion 34.

At appropriate positions near the side surface portions 36, there are provided width adjusting members 35, respectively. The width adjusting members 35 are so configured as to be slidable in the leftward and rightward directions in accordance with the size of sheets. Further, at an appropriate position near the designed surface 32, there is provided a cursor 39. With the cursor 39, a sheet width Lp is distinguished, so that a sheet effective image width Li is determined. For example, if a sheet width Lp is about 216 mm, an effective image width Li is a length which is shorter than the sheet width Lp by the lengths of margins on opposite end portions (about 6 mm each), so it becomes about 204 mm. The effective image width Li is the largest width in the width direction of the toner image formed on the image forming surface 30 of the intermediate transferring belt 12.

Figure 11:
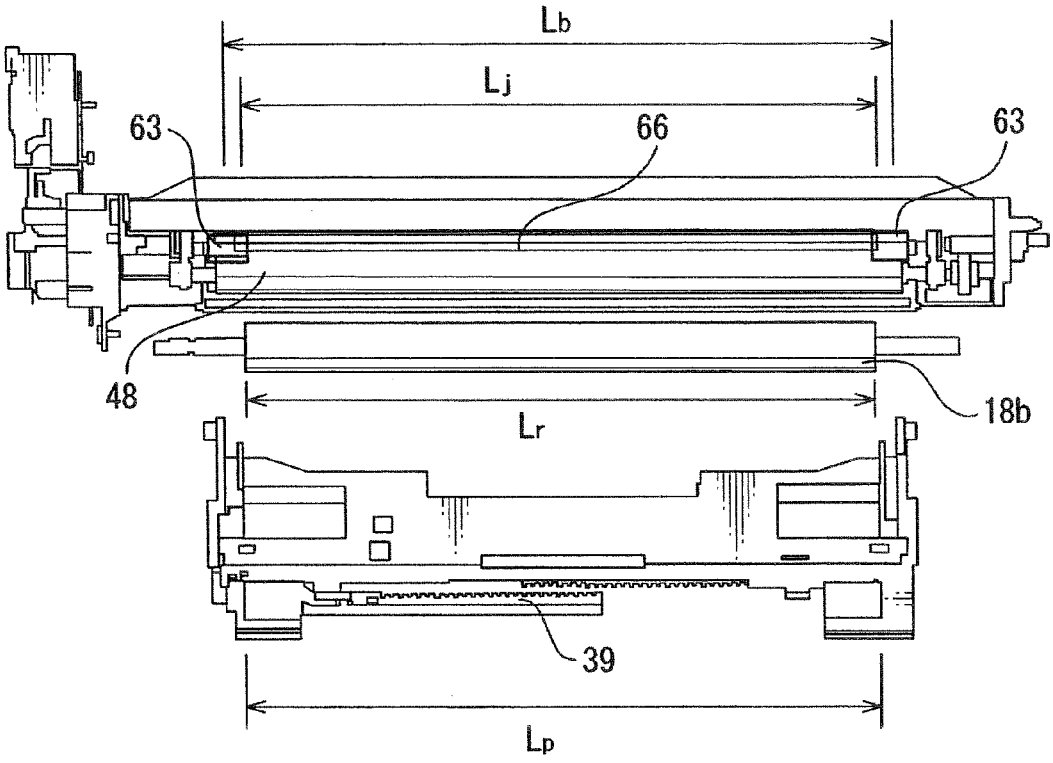
FIG. 11 shows prescribed widths in the printer.

The axial lengths of the fur brush 48, the solid lubricating member 66, and the transferring roller 18*b* are determined as shown in FIG. 11. The axial length Lj (second length) of the solid lubricating member 66 is set to be shorter than the axial length Lb (first length) of the fur brush 48. In the present embodiment, the axial length Lj of the solid lubricating member 66 is set to be about 222 mm, and on the other hand, the axial length Lb of the fur brush 48 is set to be about 227 mm.

In other words, in view of the relationship with respect to the above-described effective image width Li, the axial length Lj of the solid lubricating member 66 is set to be longer than the effective image width Li.

Further, the axial length Lj of the solid lubricating member 66 is set to be longer than the axial length Lr of the transferring roller 18*b*. In the present embodiment, the axial length Lj of the solid lubricating member 66 is set to be about 222 mm, and on the other hand, the axial length Lr of the transferring roller 18*b* is set to be about 220 mm.

Next, an operation of the printer 1 provided with the above-described cleaning unit 40 will be described. If a printing instruction is given, the sheets are conveyed one after another from the sheet-feeding cassette 24, and the sheet arrives at the registration roller 28. The registration roller 28 temporarily stops while retaining the sheet, which adjusts inclination or skew of the sheet. After the adjustment, the registration roller 28 sends the sheet to the transferring section 18 at a timing in synchronization with running of the intermediate transferring belt 12.

The toners bore on the developing rollers 11*a*-11*d* of the developing unit 10 are transferred to the electrostatic latent image on the photoconductive drum 4, so that toner images of respective colors are formed on the outer peripheral surface of the photoconductive drum 4. The toner images are primarily transferred from the outer peripheral surface of the photoconductive drum 4 to the surface of the intermediate transferring belt 12 sequentially, so that toner images of respective colors are superimposed. Next, a full-color toner image for one page transferred onto and superimposed on the intermediate transferring belt 12 is secondarily transferred to the sheet at the transferring section 18. After that, the toners remaining on the surface of the intermediate transferring belt 12 are removed in the cleaning unit 40.

The sheet onto which the toner image is secondarily transferred is conveyed to the fixing section 20. Then, the sheet passes through a fixing nip defined between the heating roller 20*a* and the pressing roller 20*b* to be heated and pressed, so that the toner image is fixed. After passing through the fixing section 20, the sheet is discharged to the sheet-discharging tray 22. This is the case of the one-sided printing.

In the case where the double-sided printing is performed, after the sheet passes through the fixing section 20, a part of the sheet projects on the sheet-discharging tray 22. After that, the sheet is pulled back to a sheet-reversing passage 23 by a reverse rotation of the roller 21. The sheet passes through the registration roller 28 and then is conveyed toward the transferring section 18 again. In this case, a toner image is secondarily transferred to a side on which the sheet has not been printed.

In such printer 1, according to the present embodiment, the cleaning unit 40 cleans the image forming surface 30 of the intermediate transferring belt 12. In other words, the cleaning unit 40 has the fur brush 48, and the image forming surface 30 bearing the remaining toners is cleaned by the fur brush 48. Further, the cleaning unit 40 has the solid lubricating member 66, so that friction on the image forming surface 30 is reduced.

The axial length Lj (about 222 mm) of the solid lubricating member 66 is so configured as to be shorter than the axial length Lb (about 227 mm) of the brush. In other words, the solid lubricating member 66 comes in contact with the fur brush 48 in an entire width, so that solid lubricating member 66 is worn throughout an area in its axial length. As a result, the surface friction factor of the image forming surface 30 can be suppressed to be low so that favorable image quality can be maintained. Further, the solid lubricating member 66 becomes maintenance-free, so that it contributes to extend duration of the cleaning unit 40.

Further, the axial length Lj of the solid lubricating member 66 is so set as to be longer than the effective image width Li (about 204 mm) of the sheet. In other words, since lubricity is given to the image forming surface 30 in a length longer than the effective image width Li, parts such as the image forming surface 30 and opposite end portions of the sheet which are especially likely to be whitened become unlikely to be contaminated by, for example, the smoother of the sheet and the external additive for toners. As a result, favorable image quality can be maintained.

Further, the axial length Lj of the solid lubricating member 66 is so set as to be longer than the roller width Lr (about 220 mm) of the transferring roller 18*b*. In other words, since lubricity is given to the image forming surface 30 described above in a length longer than the roller width Lr, the image forming surface 30 and opposite end portions of the roller 18*b* become unlikely to be contaminated by, for example, the smoother of the sheet and the external additive for toners. Therefore, favorable image quality can be maintained also in this case. This contributes to improve reliability of the printer 1.

Furthermore, the fur brush 48 is so configured as to be longer than the solid lubricating member 66, and there are areas (noncontact portion) not facing the solid lubricating member 66 on opposite end portions of the fur brush 48. The sheets 63 are disposed on these areas, so that the remaining toners adhered to the fur brush 48 may be accumulated and collected in the housing 42. Therefore, dispersing of toners at the opposite end portions of the fur brush 48 can be prevented, so that contamination in periphery can be prevented.

The present invention is not limited to the embodiment described above, and various modifications can be made within the scope of claims of the present invention.

For example, the cleaning member is not limited to the fur brush 48 of the embodiment. Further, in the embodiment, the stay 62 and the solid lubricating member 66 are capable of coming in contact with the fur brush 48 under their own weights. However, an elastic member may be engaged to the stay 62 like a torsion spring so that a biasing force makes the solid lubricating member 66 to come in contact with the fur brush 48.

In the embodiment, the printer 1 as an image forming apparatus having the intermediate transferring belt 12 is described. A cleaning device in accordance with the present invention may be a device for cleaning an image forming surface of a printer which does not have the intermediate transferring belt 12, in other words, an image forming surface of a photoconductive drum bearing remaining toners. Further, the present invention can be applied not only to the printer but also to other image forming apparatuses such as a complex machine, a copying machine, a facsimile machine, and the like.

The embodiment described above mainly includes the invention having the following configurations.

A cleaning device in accordance with an aspect of the present invention includes a cleaning device for cleaning a toner image forming surface of a rotating image bearing member. The cleaning device includes: a cleaning member for cleaning the image forming surface, the cleaning member having a first length in a width direction which is perpendicular to a rotational direction of the image bearing member, and being capable of coming in contact with and separating from the image forming surface; and a solid lubricating member which comes in contact with the cleaning member to give a lubricity to the image forming surface through the cleaning member, the solid lubricating member having a second length in the width direction which is shorter than the first length.

According to this configuration, the cleaning device has a cleaning member, so that an image forming surface bearing remaining toners is cleaned by the cleaning member. Further, the cleaning device has a solid lubricating member to give lubricity to the image forming surface, so that friction in the image forming surface is reduced. A second length of the solid lubricating member is set to be shorter than a first length of the cleaning member. Accordingly, the solid lubricating member comes in contact with the cleaning member in its entire width, so that the surface friction factor of the image forming surface of the image bearing member is suppressed to be low to maintain favorable image quality. Further, the solid lubricating member becomes maintenance-free. Accordingly, it contributes to extend duration of the cleaning device.

In the configuration above, it is preferable that the cleaning device further includes: a closing member arranged at a widthwise end portion of the solid lubricating member so as to oppose to a widthwise end portion of the cleaning member. In particular, it is preferable that the cleaning member and the solid lubricating member are so arranged that respective widthwise centers are substantially aligned, and the closing member is provided at each of widthwise end portions of the solid lubricating member so as to oppose to widthwise end portions of the cleaning members, respectively.

By setting the cleaning member to be longer than the solid lubricating member, areas which are not in contact with the solid lubricating member are present on opposite end portions of the cleaning member. According to the configuration described above, the closing members are arranged at the areas. Accordingly, remaining toners adhered to the cleaning member are collected, so that contamination in periphery can be prevented.

In the configuration above, it is preferable that the cleaning member has a shaft extending in the width direction, and being a roller-like brush member rotating about the shaft, and the solid lubricating member includes a rectangular solid so provided as to be substantially parallel to the shaft of the roller-like brush member. According to this configuration, a structure for making the solid lubricating member come in contact with the cleaning member evenly can be simplified.

In this case, it is preferable that the cleaning device further includes a closing member provided at each of widthwise end portions of the solid lubricating member, and that the roller-like brush member and the solid lubricating member are so arranged that respective widthwise centers are substantially aligned, and at opposite end portions of the roller-like brush member, non-contact portions which do not come in contact with the solid lubricating member are formed in accordance with the difference between the first length and the second length, and the closing member is provided so as to oppose to the non-contact portions, and a widthwise length of the closing member is substantially equal to a widthwise length of the non-contact portion.

According to this configuration, since the closing members are so arranged as to face the non-contact portions of the roller-like brush member, the remaining toners adhered to the roller-like brush member are collected, so that contamination in periphery can be prevented.

In the configuration described above, it is preferable that the cleaning device further includes a retaining stay for retaining the solid lubricating member, and that the closing member is an elastic sheet attached to the retaining stay. According to this configuration, the retaining member of the solid lubricating member and the retaining member of the closing member can be shared.

In the configuration described above, it is preferable that the second length is longer than the maximum width of a toner image formed on the image forming surface. According to this configuration, the widthwise length of the solid lubricating member is set to be longer than the maximum width of the toner image formed on the image forming surface, in other words, an effective image width of the sheet-like recording medium onto which the toner image is transferred. In other words, since lubricity is given to the image forming surface of the image bearing member in a length longer than the effective image width, contamination on the image forming surface and opposite end portions of the medium can be avoided. As a result, favorable image quality can be maintained.

An image forming apparatus in accordance with another aspect of the present invention includes: a rotating image bearing member having an image forming surface on which a toner image is formed; and a cleaning device for cleaning the image forming surface. The cleaning device includes: a cleaning member for cleaning the image forming surface, the cleaning member having a first length in a width direction which is perpendicular to a rotational direction of the image bearing member, and being capable of coming in contact with and separating from the image forming surface; and a solid lubricating member which comes in contact with the cleaning member to give a lubricity to the image forming surface through the cleaning member, the solid lubricating member having a second length in the width direction which is shorter than the first length.

According to this configuration, cleaning ability of the cleaning device is excellent, and a favorable image can be obtained. As a result, it contributes to enhance reliability of the image forming apparatus.

In the configuration above, it is preferable that the image forming apparatus further includes a photoconductive drum having a peripheral surface on which a toner image is formed, and the image bearing member includes an intermediate transferring belt for bearing a toner image which is primarily transferred from the photoconductive drum, and secondarily transferring the toner image to a sheet-like recording medium. According to this configuration, degree of cleaning and lubricity of the surface of the intermediate transferring belt can be maintained appropriately.

In the configuration above, it is preferable that the image forming apparatus further includes a transferring member for transferring the toner image to the sheet-like recording medium, and the second length is longer than the widthwise length of the transferring member.

According to this configuration, lubricity is given to the image forming surface in a length longer than a widthwise length of the transferring member. Accordingly, contamination in the image forming surface and opposite end portions of the transferring member can be avoided. As a result, favorable image quality can be maintained.

In the configuration above, it is preferable that the image forming apparatus further includes a transferring roller having a rotational shaft extending in a widthwise direction, the transferring roller being adapted for transferring the toner image formed on the intermediate transferring belt to the sheet-like recording medium, and the second length is longer than a widthwise length of the transferring roller. Especially, it is preferable that the second length is longer than the maximum width of a toner image formed on the image forming surface of the intermediate transferring belt and longer than a widthwise length of the transferring roller.

As described above, according to the present invention, a cleaning device capable of making the lubricating agent be maintenance-free and enhancing image quality, and an image forming apparatus provided with the same can be provided.

This application is based on Japanese Patent application serial No. 2007-217898 filed in Japan Patent Office on Aug. 24, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A cleaning device for cleaning a toner image forming surface of a rotating image bearing member, comprising:

a cleaning member for cleaning the image forming surface, the cleaning member having a first length in a width direction which is perpendicular to a rotational direction of the image bearing member, and being capable of coming in contact with and separating from the image forming surface;

a solid lubricating member that gives a lubricity to the image forming surface through the cleaning member, the solid lubricating member having a second length in the width direction which is shorter than the first length;

a retaining member that fixedly retains the solid lubricating member; and a mechanism that changes the cleaning member between a first posture where the cleaning member is away from the image forming surface, and a second posture where the cleaning member is contacted with the image forming surface, wherein the cleaning member is not contacted with the solid lubricating member when the cleaning member is in the first posture, and the cleaning member is contacted with the solid lubricating member when the cleaning member is in the second posture.

2. The cleaning device according to claim 1, further comprising:

a closing member arranged at a widthwise end portion of the solid lubricating member so as to oppose to a widthwise end portion of the cleaning member.

3. The cleaning device according to claim 2, wherein the cleaning member and the solid lubricating member are so arranged that respective widthwise centers are substantially aligned, and the closing member is provided at each of widthwise end portions of the solid lubricating member so as to oppose to widthwise end portions of the cleaning members, respectively.

4. The cleaning device according to claim 1, wherein the cleaning member has a shaft extending in the width direction, and being a roller-like brush member rotating about the shaft, and the solid lubricating member includes a rectangular solid so provided as to be substantially parallel to the shaft of the roller-like brush member.

5. The cleaning device according to claim 4, further comprising:

a closing member provided at each of widthwise end portions of the solid lubricating member, wherein the roller-like brush member and the solid lubricating member are so arranged that respective widthwise centers are substantially aligned, and at opposite end portions of the roller-like brush member, non-contact portions which do not come in contact with the solid lubricating member are formed in accordance with the difference between the first length and the second length, and the closing member is provided so as to oppose to the non-contact portions, and a widthwise length of the closing member is substantially equal to a widthwise length of the non-contact portion.

6. The cleaning device according to claim 5, wherein the closing member is an elastic sheet attached to the retaining member.

7. The cleaning device according to claim 1, wherein the second length is longer than the maximum width of a toner image formed on the image forming surface.

8. An image forming apparatus, comprising:

a rotating image bearing member having an image forming surface on which a toner image is formed; and a cleaning device for cleaning the image forming surface, wherein the cleaning device includes:

a cleaning member for cleaning the image forming surface, the cleaning member having a first length in a width direction which is perpendicular to a rotational direction of the image bearing member, and being capable of coming in contact with and separating from the image forming surface;

a solid lubricating member that gives a lubricity to the image forming surface through the cleaning member, the solid lubricating member having a second length in the width direction which is shorter than the first length;

a retaining member that fixedly retains the solid lubricating member; and a mechanism that changes the cleaning member between a first posture where the cleaning member is away from the image forming surface, and a second posture where the cleaning member is contacted with the image forming surface, wherein the cleaning member is not contacted with the solid lubricating member when the cleaning member is in the first posture, and the cleaning member is contacted with the solid lubricating member when the cleaning member is in the second posture.

9. The image forming apparatus according to claim 8, further comprising:

a photoconductive drum having a peripheral surface on which a toner image is formed, wherein the image bearing member includes an intermediate transferring belt for bearing a toner image which is primarily transferred from the photoconductive drum, and secondarily transferring the toner image to a sheet-like recording medium.

10. The image forming apparatus according to claim 8, further comprising:

a closing member arranged at a widthwise end portion of the solid lubricating member so as to oppose to a widthwise end portion of the cleaning member.

11. The image forming apparatus according to claim 10, wherein the cleaning member and the solid lubricating member are so arranged that respective widthwise centers are substantially aligned, and the closing member is provided at each of widthwise end portions of the solid lubricating member so as to oppose to widthwise end portions of the cleaning members, respectively.

12. The image forming apparatus according to claim 8, wherein the cleaning member has a shaft extending in the width direction, and being a roller-like brush member rotating about the shaft, and the solid lubricating member includes a rectangular solid so provided as to be substantially parallel to the shaft of the roller-like brush member.

13. The image forming apparatus according to claim 12, further comprising:

a closing member provided at each of widthwise end portions of the solid lubricating member, wherein the roller-like brush member and the solid lubricating member are so arranged that respective widthwise centers are substantially aligned, and at opposite end portions of the roller-like brush member, non-contact portions which do not come in contact with the solid lubricating member are formed in accordance with the difference between the first length and the second length, and the closing member is provided so as to oppose to the non-contact portions, and a widthwise length of the closing member is substantially equal to a widthwise length of the non-contact portion.

14. The image forming apparatus according to claim 13, wherein the closing member is an elastic sheet attached to the retaining member.

15. The image forming apparatus according to claim 8, wherein the second length is longer than the maximum width of a toner image formed on the image forming surface.

16. The image forming apparatus according to claim 8, further comprising:

a transferring member for transferring the toner image to the sheet-like recording medium, wherein the second length is longer than the widthwise length of the transferring member.

17. The image forming apparatus according to claim 9, further comprising:

a transferring roller having a rotational shaft extending in a widthwise direction, the transferring roller being adapted for transferring the toner image formed on the intermediate transferring belt to the sheet-like recording medium, wherein the second length is longer than a widthwise length of the transferring roller.

18. The image forming apparatus according to claim 9, further comprising:

a transferring roller having a rotational shaft extending in a widthwise direction, the transferring roller being adapted for transferring the toner image formed on the intermediate transferring belt to the sheet-like recording medium, wherein the second length is longer than the maximum width of a toner image formed on the image forming surface of the intermediate transferring belt and longer than a widthwise length of the transferring roller.

* * * * *